US005349970A

United States Patent [19]

Razzouq

[11] Patent Number: 5,349,970

[45] **Date of Patent: * Sep. 27, 1994**

[54] METHOD FOR FOILING HAIR

[76] Inventor: Peter Y. Razzouq, 20218 Hickory Wind Dr., Humble, Tex. 77346

[ * ] Notice: The portion of the term of this patent subsequent to Dec. 27, 2010 has been disclaimed.

[21] Appl. No.: 962,705

[22] Filed: Oct. 19, 1992

[51] Int. Cl.[5] ..... A45D 19/18; A61K 7/135

[52] U.S. Cl. ..... 132/208; 132/270

[58] Field of Search ..... 132/208, 202, 222, 270

[56] References Cited

U.S. PATENT DOCUMENTS

| | | | |
|---|---|---|---|
| 3,349,781 | 10/1967 | Poole et al. | 132/208 |
| 4,224,954 | 9/1980 | Stahl | 132/208 |
| 4,880,019 | 11/1989 | Roubo | 132/270 |

FOREIGN PATENT DOCUMENTS

| | | | |
|---|---|---|---|
| 3142942 | 7/1983 | Fed. Rep. of Germany | 132/208 |

*Primary Examiner*—Gene Mancene
*Assistant Examiner*—Todd E. Manahan

[57] ABSTRACT

A method of foiling hair includes the steps of positioning a rigid planar member so as to have one end in abutment with a surface of a head of one person and another end in abutment with a chest of another person, placing a strip of a foil material over a top surface of the rigid planar member, extending a strand of hair from the head over the foil material, and applying a hair treatment solution to the strand of hair. The rigid planar member is positioned so as to extend downwardly from the chest to the head. A plurality of strips of foil material are formed prior to the step of positioning. The step of applying includes brushing the hair treatment solution onto the strand of hair and onto the foil material. This method further includes the step of removing the rigid planar member from beneath the strip of foil material so as to cause the strip of foil material to adhere to the strand of hair.

17 Claims, 1 Drawing Sheet

METHOD FOR FOILING HAIR

TECHNICAL FIELD

The present invention relates to foiling hair, generally. More particularly, the present invention relates to methods and apparatus used for hair treatment and, in particular, the styling of hair.

BACKGROUND ART

In recent years it has become fashionable to highlight and streak the hair to add interest and attractiveness. While this practice might seem simple to the layman, professional hair colorists and those individuals who have attempted to streak or highlight their own hair or that of another realize that considerable skill and technique is necessary to obtain even a passable job and that truly professional results are very difficult to achieve. For this reason, many techniques have been developed for highlighting and streaking hair which have various advantages and disadvantages and which provide varying degrees of success, depending upon the skill of the operator and other factors.

An excellent, but very difficult technique, is the basic foil method in which a sheet of aluminum foil is held under the hair to be treated. The hair to be treated or colored is first woven by well-known techniques and then a sheet of aluminum foil is held against the scalp and hair of the head with the edge of the foil as closely adjacent to the roots of the hair to be treated as possible. The desired bleach, dye, or other product is then applied to the hair so-isolated. The lower free end of the aluminum foil is folded or rolled toward the head until out of the way of the next portion of hair to be treated. The sides are then folded inwardly to form a crimped envelope or package completely enclosing the treated hair. The hair is allowed to process for the required period of time and then the foil package is removed. Normally, the plurality of portions of hair that are treated in this manner aggravates the problem of holding the foil in place, both during application of the treating agent and during processing. This requires great care and more than one pair of hands so that an assistant must be employed to do the tedious and exacting job of holding the foils in place. Any movement of the person's head or a slip by the operator or assistant leads to spotting or bleaching where it is not wanted. While this method can provide excellent results and close bleaching at the root of the hair, it is very difficult to perform properly. Also, it is expensive in requiring the time of an assistant to cut the sheets of foil and to hold them in place.

In the foil method of treating hair, prior art techniques have used a tool for the application of the foil. This tool is a flat piece of wood about one-eighth inch in thickness and approximately four inches wide and five inches long. The paddle has a handle on it so that a person can hold it with one hand while applying bleach, or any other hair lightening product, with the other hand. This technique is very time-consuming and insufficient for various reasons. First, the use of one hand to hold the paddle leaves the second hand with all the work; from applying the foil on the paddle to weaving to hair, applying the product on the paddle and folding the foil. This results in low speed application that can take anywhere from two to three hours. The thickness of the wood results in the inability to get full coverage for the weaved hair. This, in turn, results in uneven application and uneven or incomplete hair color. In most cases, an assistant is required either to hold the paddle, cut the foil, or to apply color. In all of these instances, the client is very unhappy when the client has to sit in the chair for three hours. This is extremely discouraging to the client and generally results in the failure to return for additional treatment.

In the past, various U.S. patents have issued relating to the various techniques for coloring and treating hair. U.S. Pat. No. 3,349,781, issued on Oct. 31, 1967, to R. J. Poole describes a coloring or bleaching method in which entire layers of hair are simultaneously treated with bleach so as to produce contrasting streaks in the hair. A special applicator is provided which is a brush having spaced series of tufts of bristles. The treatment is carried on over a protective sheet of aluminum foil.

U.S. Pat. No. 3,921,647, issued on Nov. 25, 1975, to K. C. Fisher describes an apparatus for chemically treating selected bundles of hair. This apparatus includes a clamping platform and a clip slidable therein. The platform includes a pair of jaws and a planar surface with the surface being disposed substantially orthogonal to the jaws. The selected hair is captured in the Jaws so as to allow the planar surface to press against the hair directly immediately thereunder and the scalp. A foil sheet is interposed and held by action of the planar surface and the scalp so as to achieve isolation of the selected bundle of hair.

U.S. Pat. No. 4,074,964, issued on Feb. 21, 1978, to H. D. Wells provides a method of coloring hair which consists of parting the hair in a manner so as to define a plurality of individual hair sectors on the scalp. A hair dresser's tape is applied to the scalp along all of the part lines and a double-side adhesive tape is applied over the hair dresser's tape. One or more hair tressed segments are wrapped in rectangular pieces of liquid impervious sheet material. The packets are adhesively held in this position during the hair treatment.

U.S. Pat. No. 4,196,741, issued on Apr. 8, 1980, to S. M. Minghanelli provides a liquid-impermeable sheet, made of aluminum foil, having a coating of pressure-sensitive adhesive. The process of this method involves separating a portion of hair to be treated, adhering one of the liquid-impermeable sheets to the scalp, and treating the selected portion of hair with a desired liquid-treating agent. The sheet is folded or rolled toward the head and the edges are folded inwardly so as to form an envelope.

U.S. Pat. No. 4,224,954, issued on Sep. 30, 1980, to M. L. Stahl discloses a device for use in bleaching or coloring hair. This device includes a thin planar base member having a hand grip portion at one end and a generally U-shaped top member having a transverse span portion atop the base member, adjacent the hand grip portion. A pair of generally parallel arms or thin planar materials extend from the span portion. A moisture impervious flexible sheet of a suitable material, such as aluminum foil, is disposed between the base and the U-shaped top members. A lock of hair is disposed over at least a portion of the central area of the foil, and a hair coloring or bleaching fluid is applied thereto.

U.S. Pat. No. 4,658,840, issued on Apr. 21, 1987, to D. C. McCosker discloses a strip for facilitating the selective coloring of hair. A thin sheet of flexible elastic plastic material is provided which has a plurality of sets of openings. The openings are used to hold strands of hair which, in turn, hold the sheet to the scalp.

U.S. Pat. No. 4,672,983, issued on Jun. 16, 1987, to Nath et al., provides a method for performing a hair coloring treatment. This employs the use of a sheet of plastic material. The sheet of plastic material is folded along predetermined fold lines over and about a section of hair to be treated. This forms a generally closed pocket so as to allow the hair to be configured within the pocket for a desired period of time.

U.S. Pat. No. 5,056,539, issued on Oct. 15, 1991, to K. G. Abramson shows a product and method for coloring selective areas of hair. This device is an improved method for foiling hair by using a segment of aluminum foil having two window panes of transparent material arranged equidistant from each other such that when the foil is folded in half, the two panes are aligned one on top of the other.

It is an object of the present invention to provide an improved foiler which greatly speeds the process of treating hair.

It is another object of the present invention to provide a method of foiling which allows the single hair dresser the ability to properly manipulate the hair with two hands.

It is a further object of the present invention to provide a foiling apparatus and method which is relatively inexpensive, easy to use, and time-effective.

These and other objects and advantages of the present invention will become apparent from a reading of the attached specification and appended claims.

SUMMARY OF THE INVENTION

The present invention is an improved method of foiling hair which comprises the steps of (1) positioning a rigid planar member so as to have one end in abutment with a surface of the head of one person and another end in abutment with a chest of another person; (2) placing a strip of a foil material over a top surface of the rigid planar member; (3) extending a strand of hair from the head over the foil material; and (4) applying a hair treatment solution to the strand of hair.

The step of positioning includes the steps of: (1) moving the rigid planar member to a position adjacent the roots of the strand of hair; and (2) resting the other end adjacent the chest of the hair dresser so as to cause the rigid planar member to extend angularly downwardly to the head of the client.

The method of the present invention also includes the step of forming a plurality of strips of foil material prior to the step of positioning. Specifically, the step of forming includes cutting the strips of foil material to a size corresponding to a size of the top surface of the rigid planar member. The rigid planar member is formed from a sheet of anodized aluminum material. The sheet has a thickness of 0.025 inches and a length of more than one foot. The rigid planar member also has a width of not more than four inches.

The step of applying the solution includes brushing the hair treatment solution onto the strand of hair and onto the strip of foil material. The strand of hair is removably adhered to the strip of foil material. After this step, the rigid planar member is removed from beneath the strip of foil material so as to cause the strip of foil material to adhere to the strand of hair. The rigid planar member can then be reposition to another location in abutment with the head of the person. After the treatment process has been completed, the strip of foil material is removed from the strand of hair after a predetermined period of time.

DETAILED DESCRIPTION OF THE INVENTION

Figure 1:
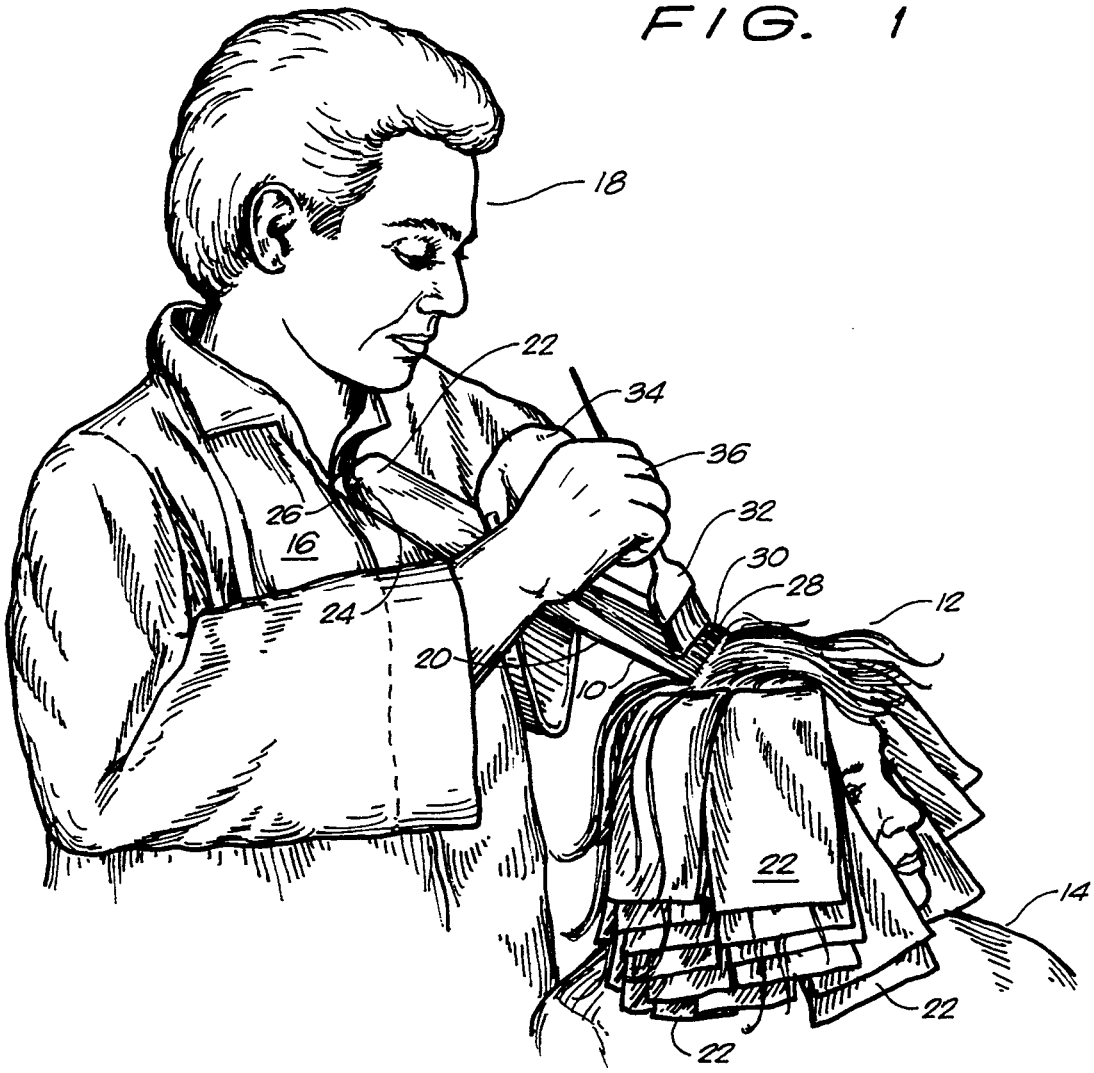
FIG. 1 is a perspective view showing the use of the method and apparatus of the present invention.

Referring to FIG. 1, there is shown at 10 the apparatus used for the foiling of hair in accordance with the preferred embodiment of the present invention. Additionally, in FIG. 2, the apparatus for the foiling of hair is shown in an isolated view. In FIG. 1, the apparatus 10 is shown as positioned between the head 12 of client 14 and the chest 16 of hair dresser 18. The foiler 10 includes a rigid planar member 20 extending from the head 12 to the chest 16. On the top surface of the foiler 20 is a strip of foil material 22. For the purposes of illustration, it can be seen that the strip of foil material 22 overlies the top surface of the foiler 20. In FIG. 1, it can be seen that edge 24 is folded backwardly so as to expose the top surface 26 of the foiler 10.

The method of the present invention, as illustrated in FIG. 1, initially involves the step of positioning the rigid planar member 10 so as to have one end 28 in abutment with a surface of head 12 of the client 14. The rigid planar member 10 also has another end in abutment with the chest 16 of hair dresser 18. It can be seen that the rigid planar member 10 has a generally rectangular configuration. In actual use, the rigid planar member 10 will have a length of greater than one foot. This length provides the ideal amount of spacing between the hair dresser 18 and the client 14. Additionally, a length of twelve and three-quarters inches has been found to be an ideal length so as to facilitate the ability to rapidly carry out the tasks needed for the treatment of the client 14. The actual length of the foiler 10 can vary in accordance with the desires of the hair dresser 18.

In FIG. 1, it can be seen that the foiler 10 rests comfortably at an angle between the chest 16 and the head 12. This allows the hair dresser 18 to carry out the necessary tasks for the treatment of the hair 30 on the head 12 of client 14. The angled positioning of the foiler 10 allows the bottom edge to be placed in very close proximity to the roots of the hair 30. This angled arrangement allows for the hair dresser 18 to properly manipulate the foiler 10, the hair 30, and his brush 32. This can be achieved without undue discomfort to the client 14 or to the hair dresser 18. In simple terms, the rigid planar member 10 provides a convenient working surface for the hair dresser 18. This allows the necessary tasks associated with the coloring of the hair 30 to be carried out without the need for an assistant and without the need for undue manipulations.

Initially, a strip of foil material 22 is placed over the top surface 26 of the rigid planar member 10. In the method of the present invention, the strips 22 are formed prior to the step of positioning the rigid planar member 10 against the head 12 of client 14. The step of forming simply involves cutting the strips of foil material to a size generally corresponding to the size of the top surface 26 of the rigid planar member 10. In normal operations, a stack of such strips 22 can be positioned within easy reach of the hair dresser 18. As can be seen in FIG. 1, a large number of such strips 22 are needed throughout the hair coloring process. The method of the present invention allows the hair dresser 18 to properly plan the needs of the client 14 and to provide the necessary foil sheets prior to the treatment process.

In the method of the present invention, a segment of hair 30 is pulled outwardly from the head 12 onto the top surface of the foil 22 on the rigid planar member 10. The amount of hair actually pulled over the foiler 10 will be within the desire and knowledge of the hair dresser 18. A variety of techniques can be employed, each of which can call for various sized segments of hair. When the hair 30 is extended over the foil 22, the hair dresser 18 is free to manipulate brush 32 so as to apply a hair treatment solution to the hair 30. As can be seen, the hair dresser 18 has one hand 34 available for pulling the hair 30, in a taut manner, onto the foil 22. The hair dresser also has a second hand 36 available for brushing the hair treatment solution onto the hair 30. With the use of the present invention, there is no requirement for an additional hair dresser (or assistant) and no requirement for undue manipulation of either the foiler 10 or the brush 32.

During the step of brushing the hair treatment solution onto the hair 32, the treatment solution will also reside on the foil material 22. This will cause the hair segment 30 to adhere to the foil material 22 in a removable fashion. After the hair treatment solution has been brushed onto the hair 30, the rigid planar member 10 can be removed from beneath the strip of foil material 22. This causes the foil material 22 to reside with the hair 30 in the manner illustrated in conjunction with the other foil sheets 22 in FIG. 1. The rigid planar member 10 is then repositioned to another location for treatment of another segment of hair. As in conventional foiling techniques, the strip of foil material 22 is removed from the strand of hair 30 after a predetermined period of time. This period of time will be the time required for the hair treatment solution to properly act on the hair 30.

The treatment solution can be a variety of chemical products. Traditional paddles, in the prior art, have only been used with bleach. However, because the foiler 10 is made of an anodized aluminum material, various other chemical products can also be used on hair 30. For example, traditional bleach can be used to highlight hair. Color deposit products like MATRIX (TM) and FARMACI (TM), and HENNA (TM) can all be used. Various chemical products can be used for relaxing perms and curly hair. The apparatus of the present invention can further be used for the retouching of roots. Products such as SUNGLITZ (TM), ULTRAGLITZ (TM), DIAMONDGLITZ (TM), and E-Z GLITZ (TM) can further be used for the highlighting of hair.

The method of the present invention provides hair dresser 18 with the freedom of using two hands. This is accomplished by supporting one end of the foiler 10 against the hair dresser's chest 16 and the other end against the client's head 12. By carrying out this operation, and by having pre-cut foils, the application time can drop from three hours all the way to one-half hour. The use of the method of the present invention, along with the apparatus of the present invention, can triple the amount of work that can be carried out in the same period of time. Additionally, this can serve to triple income to the hair dresser 18. The very thin foiler 10 has better access to the roots of hair 30 than do conventional paddles. This achieves much better results for the client 14. The method of the present invention does not require the use of a helper. This serves to cut costs to the hair dresser 18. Additionally, by reducing the amount of time for the carry out of the coloring process, the client 14 is inconvenienced minimally. This results in a service that the client will come back for again and again. The foiling technique of the present invention can effectively treat hair so as to last from two to four months. Other techniques and products only last for approximately one month. As such, the present invention achieves advantages not found in the prior art techniques.

Figure 2:
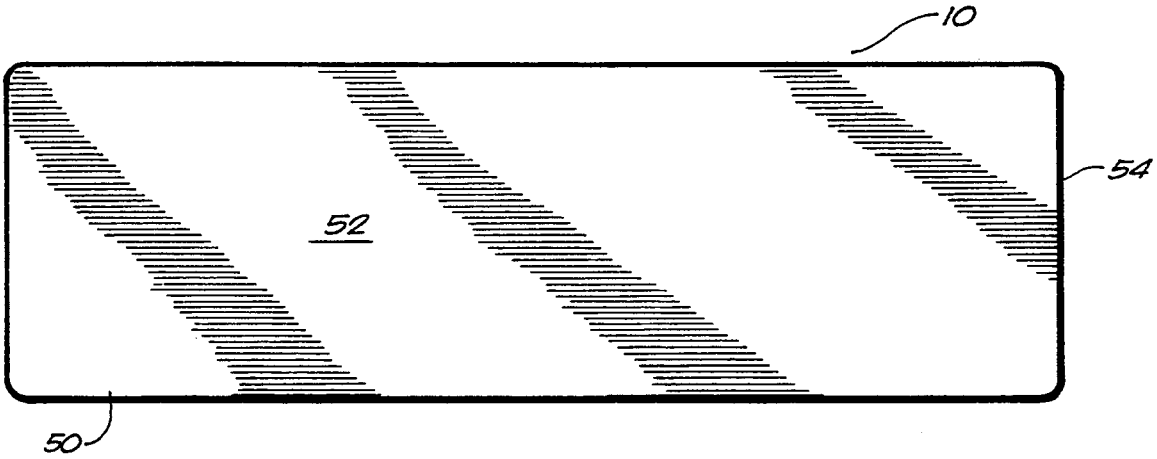
FIG. 2 is a planar view of the top surface of the foiling apparatus of the present invention.

Referring to FIG. 2, there is shown at 10, the foiler in accordance with the preferred embodiment of the present invention. The foiler 10 is a rigid planar member 50 which has a top surface 52 of an anodized aluminum material. The rigid planar member 50 has a length of greater than one foot. As was described in conjunction with FIG. 1, a strip of foil material is removably positioned in surface-to-surface contact with the top surface 52 of the rigid planar member 50. It can be seen that the foiler 10 has a generally rectangular configuration. One end 54 has a shape and configuration which is suitable for abutment with the head 12 of a person. The foil material applied to the top surface 52 of foiler 10 will have a length at least as long as the rigid planar member 50. The foil material will also have a width which generally corresponds to the width of the rigid planar member 50. The rigid planar member 50 has a thickness of approximately 0.025 inches. The width of the device will be generally less than four inches. In use, the foiler 10 can be made in a variety of colors. If desired, names and advertisements can be silk-screened on the top surface 52.

The foregoing disclosure and description of the invention is illustrative and explanatory thereof. Various changes in the details of the illustrated apparatus, or in the steps of the described method, can be made within the scope of the appended claims without departing from the true spirit of the invention. The present invention should only be limited by the following claims and their legal equivalents.

I claim:

1. An improved method of foiling hair comprising the steps of:

positioning a rigid planar member so as to have one end in abutment with a surface of a head of one person and another end in abutment with a chest of another person;

placing a strip of a foil material over a top surface of said rigid planar member;

extending a strand of hair from said head over said foil material; and applying a hair treatment solution to said strand of hair.

2. The method of claim 1, said step of positioning comprising:

moving said rigid planar member to a position adjacent root of said strand of hair; and resting said another end against the chest so as to cause said rigid planar member to extend angularly downwardly to said head.

3. The method of claim 1, said step of positioning comprising:

positioning said rigid planar member so as to extend downwardly from said chest to said head.

4. The method of claim 1, further comprising the step of:

forming a plurality of strips of foil material prior to the step of positioning.

5. The method of claim 4, said step of forming comprising:

cutting the strips of foil material to a size corresponding to a size of said top surface of said rigid planar member.

6. The method of claim 1, further comprising the step of:

forming the rigid planar member from a sheet of anodized aluminum material.

7. The method of claim 6, said sheet having a thickness of 0.025 inches, said rigid planar member having a length of more than one foot.

8. The method of claim 1, said step of applying comprising:

brushing said hair treatment solution onto said strand of hair and onto said strip of foil material.

9. The method of claim 8, further comprising the step of:

adhering said strand of hair to said strip of foil material.

10. The method of claim 1, further comprising the step of:

removing said rigid planar member from beneath said strip of foil material so as to cause said strip of foil material to adhere to said strand of hair.

11. The method of claim 10, further comprising the step of:

repositioning said rigid planar member to another location in abutment with the head.

12. The method of claim 10, further comprising the step of:

removing said strip of foil material from said strand of hair after a predetermined period of time.

13. An improved method of foiling hair comprising the steps of:

positioning a rigid rectangular member so as to have one end in abutment with a head of a first person and another end in abutment with a chest of a second person;

placing a strip of a foil material over a top surface of said rigid rectangular member;

extending a strand of hair from said head over said strip of foil material, said step of extending being by said second person; and applying a hair treatment solution to said strand of hair, said step of applying being by said second person.

14. The method of claim 13, said step of extending comprising:

extending said strand of hair with a first hand of said second person, said strand of hair in surface-to-surface contact with said foil material.

15. The method of claim 14, said step of applying comprising:

applying said hair treatment solution with a second hand of said second person, said first hand causing said strand to remove taut during said step of applying.

16. The method of claim 13, said step of positioning comprising:

moving said rigid rectangular member to a position adjacent roots of said strand of hair; and resting said another end adjacent the chest so as to cause said rigid rectangular member to extend angularly downwardly to said head.

17. The method of claim 13, further comprising the step of:

forming a plurality of strips of foil material having a size corresponding to a size of said top surface of said rigid rectangular member prior to the step of positioning.

* * * * *